United States Patent [19]

Marttala et al.

[11] 4,456,750

[45] Jun. 26, 1984

[54] METHOD FOR CONTROLLING THE ALKALINITY OF FEED CIRCULATION WHEN PREHYDROLYZING WOOD CHIPS

[75] Inventors: Tapani Marttala; Kari Saramäki, both of Varkaus, Finland

[73] Assignee: A.Ahlstrom Osakeyhtio, Noormarkku, Finland

[21] Appl. No.: 463,068

[22] Filed: Feb. 2, 1983

[30] Foreign Application Priority Data

Feb. 11, 1982 [FI] Finland ..... 820456

[51] Int. Cl.[3] ..... D21C 3/06; D21C 3/26; D21C 1/04

[52] U.S. Cl. ..... 536/59; 162/36; 162/45; 162/83; 162/84; 162/DIG. 2

[58] Field of Search ..... 536/59; 162/36, 45, 162/83, 84, DIG. 2

[56] References Cited

U.S. PATENT DOCUMENTS 1,891,337 12/1932 Seaman ..... 162/84
3,262,839 7/1966 Lüthgens ..... 162/83

FOREIGN PATENT DOCUMENTS 1099837 2/1961 Fed. Rep. of Germany ..... 162/84
390219 11/1973 U.S.S.R. ..... 162/84
392195 11/1973 U.S.S.R. ..... 162/84

OTHER PUBLICATIONS

Pulp and Paper Manufacture, Second Edition, vol. 1, The Pulping of Wood, MacDonald, Editor, McGraw-Hill Book Company, N.Y., N.Y., 1969, pp. 428–435, 439–443, 471–478, 763 and 764.

*Primary Examiner*—Ronald W. Griffin
*Attorney, Agent, or Firm*—Bucknam and Archer

[57] ABSTRACT

A method for controlling the pH of the liquid circulation in a continuous prehydrolysis apparatus where a mineral acid or some other acid stronger than sulfurous acid is used as a hydrolysis agent and the material to be hydrolyzed is transferred, entrained in the liquids of a first and a second liquid circulation separated by a liquid exchanger, from a steaming vessel to a hydrolysis vessel by means of a transfer valve. Such an amount of alkaline sulfite or ammonium sulfite is added into the liquid of the first liquid circulation as is necessary to make the liquid alkaline or at least neutral.

7 Claims, 1 Drawing Figure

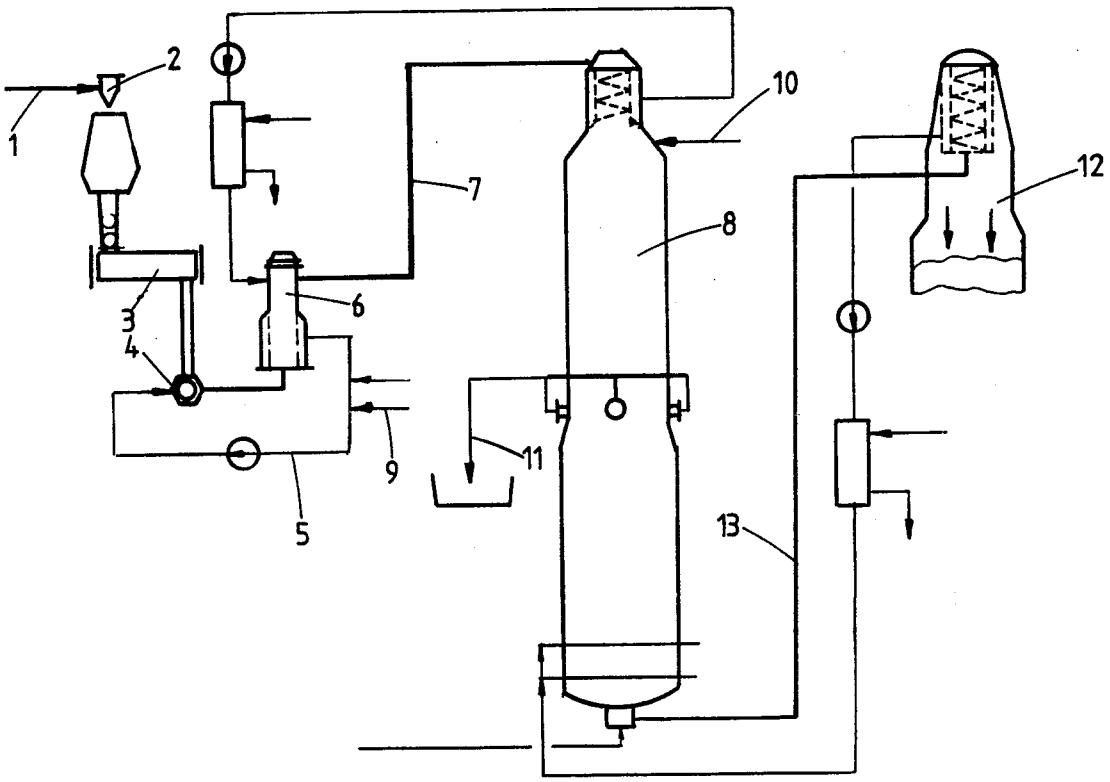
1
2
3
4
5
6
7
8
9
10
11
12
13

METHOD FOR CONTROLLING THE ALKALINITY OF FEED CIRCULATION WHEN PREHYDROLYZING WOOD CHIPS

When manufacturing prehydrolysis sulfate cellulose in a Kamyr digester the prehydrolysis stage is today carried out in a reactor which has been modified from a preimpregnation vessel and the construction and materials of which have been designed to meet the requirements of a prehydrolysis reaction.

One of the basic parts of a Kamyr digesting system is a a high pressure transfer valve through which the chips are transferred entrained in liquid from the steaming vessel to the pressurized portion of the digester, in this case to the top portion of the prehydrolysis reactor. Here the excess transfer liquid is withdrawn by filtering and returned to the high pressure transfer valve for transfer of a new chips batch.

Faultless operation of a high pressure transfer valve presupposes that the transfer liquid is at least slightly alkaline. As the conditions in the prehydrolysis vessel are acidic, the transfer liquid from this portion can not be returned into the high pressure transfer valve. A process containing a prehydrolysis stage employs therefore here two separate liquid circulations which are separated from each other by a liquid exchanger. From the liquid exchanger the chips are forwarded to the prehydrolysis reactor but the excess liquid is returned to the transfer valve. A new, acidic liquid circulation brings the chips from the liquid exchanger to the reaction vessel. Additional water required for maintaining a correct liquid-to-wood ratio is supplied into the liquid circulation of the transfer valve, the hydrolysis agent required by the acid hydrolysis is added into the transfer circulation following the liquid exchanger. As the liquid flow is directed towards the latter the pH of the liquid circulation remains low if small amounts of NaOH are continuously added into it.

According to experience approx. 0.2 moles NaOH per hydrolysis agent mole has to be added into the liquid circulation of the high pressure transfer valve to maintain the pH of the liquid adequately high. As this acid remains inefficient the amount of acid must be increased accordingly.

The NaOH requirement is thus a remarkable drawback as it results in extra acid consumption. Further more, as the acid used often is sulfuric acid, which combined with NaOH forms sodium sulfate and this as a strong electrolyte "salts out" compounds, which have colloidally dissolved in the hydrolysate, and thus causes precipitation and caramellization, the method used can not be recommended.

The object of the present invention is to substitute the NaOH added for "lubrication of the high pressure transfer valve" by another agent giving the same effect. Solutions of alkaline salts are this kind of agents, and of these the most suitable for this purpose is $Na_2SO_3$, the use of which also brings other advantages, in sulfur acid prehydrolysis in particular.

The pH of a solution containing one mole $Na_2SO_3$ per liter is 9.5. When 0.1% $Na_2SO_3$ is added into the water supplied into the liquid circulation of the high pressure transfer valve, its pH rises to apprx. 7.5. If a pH of 8.0 is desired, apprx. 0.5% $Na_2SO_3$ must be added.

The problems in the operation of the high pressure transfer valve with acidic circulation liquid are caused by the resin of the wood which sticks onto the slide surfaces of the valve and excessively increases the friction between them. Experience has shown that no problems arise when the pH is at least 6.5 to 7.0. To achieve this 0.1 to 0.2% of NaOH based on the dry weight of chips has to be added.

When $Na_2SO_3$ is used instead of NaOH and when a pH of 7.5 is desired apprx. 0.2% $Na_2SO_3$ based on the dry weight of wood is required. Although such a high alkali value would not be necessary in the circulation, provisions have to be made for it as organic acids reducing the pH are soon dissolved into the circulation liquid from the chips.

Substituting NaOH by $Na_2SO_3$ for adjustment of the pH brings many advantages compared with which the additional cost of the increased amount of chemicals can be considered low. The advantages are as follows:

when $H_2SO_4$ is used as a hydrolysis agent, the $Na_2SO_3$ used for pH control does not cause additional consumption of the agent because the $SO_2$ released by $H_2SO_4$ in the hydrolysis reactor acts as a hydrolysis agent, too;

due to $SO_2$, lignosulfonates or lignosulfonic acids are formed which stabilize the hydrolysate; thus it does not precipitate or caramellize in further treatment;

the whole prehydrolysis can thus be carried out with $SO_2$ by adding e.g. 2% $Na_2SO_3$ based on the wood weight into the circulation liquid and 0.75% $H_2SO_4$ into the reactor. The hydrolysis stage then contains 0.5% $SO_2$ and 1.1% $Na_2SO_4$. The lignosulfonic acids formed prevent the "salting-out effect" of $Na_2SO_4$;

if an amount of $Na_2SO_3$ equivalent to the amount of the hydrolysis agent is used, the sulfuric acid can be substituted by e.g. HCl, whereby there will be sodium chloride in the reactor. The amount is, however, so small that no chloride accumulations are caused in the chemical circulation of a sulfate cellulose mill.

When $Na_2SO_3$ is used instead of NaOH for pH control of the liquid circulation no additional chemicals are required.

The invention is described in detail below with reference to the accompanying drawing which is a schematic representation of the process according to the invention.

The preheated chips are supplied from a chip hopper 2 through a chip gauge and a low pressure feeder into a steaming vessel 3 where they are steamed with low pressure steam. The steaming vessel is followed by a feed channel and a high pressure transfer valve 4 having a rotor with pockets therein turning in a stationary casing, by which the chips are transferred into the pressure prehydrolysis vessel.

The liquid in a first liquid circulation 5 transfers the chips into a liquid exchanger 6, from which the liquid in a second liquid circulation 7 takes them further into the top portion of a hydrolysis vessel.

The liquid in the first circulation is made neutral or alkaline by adding an adequate amount of $Na_2SO_3$, numeral 9. The liquid in the circulation after the liquid exchanger is heated with steam while it is returned to the liquid exchanger. Liquid 10, containing an adequate amount of hydrolysis agent $H_2SO_4$ which is necessary for creating a suitable initial acidity, is supplied into the hydrolysis vessel. The formed hydrolysate 11 is withdrawn through a circular screen located halfway up in the hydrolysis vessel. From the bottom of the hydrolysis vessel the washed chips are transferred by liquid circulation 13 to a digester 12.

Beside alkaline sulfite or ammonium sulfite, it is possible to add into the first liquid circulation such an amount of spent liquor from a sulfite based cellulose digestion or hydrolysate from an $SO_2$ prehydrolysis that the liquid is alkaline or at least neutral.

Also organic acid or acids stronger than sulfurous acid may be used as a hydrolysis agent.

We claim:

1. A method of prehydrolysis of wood chips, wherein the wood chips are first subjected to the action of steam in a steaming vessel, the prehydrolysis agent is an acid stronger than sulfurous acid, a first liquid circulation system transfers the chips from the steaming vessel to a heat exchanger by means of high pressuretransfer valve, a second liquid circulation system transfers the chips from said heat exchanger to the prehydrolysis vessel, excess liquid is recirculated to the heat exchanger and then to the transfer valve and a liquid containing ammonium sulfite or an alkaline sulfite is added to the first liquid circulation system in an amount to give a pH at least neutral.

2. A method as recited in claim 1 wherein an organic acid is used as a hydrolysis agent.

3. A method as recited in claim 1 wherein a mineral acid is used as a hydrolysis agent.

4. A method as recited in claim 1 wherein $H_2SO_4$ is used as a hydrolysis agent.

5. A method as recited in claim 1, wherein 0.1 to 0.5% $Na_2SO_3$ is added into the liquid of the first liquid circulation system.

6. A method as recited in claim 1, wherein beside alkaline sulfite or ammonium sulfite such an amount of spent liquor from a sulfite based cellulose digestion is added into the first liquid circulation system that the liquid is alkaline or at least neutral.

7. A method as recited in claim 1, wherein beside alkaline sulfite or ammonium sulfite such an amount of hydrolysate from an $SO_2$ prehydrolysis is added into the first liquid circulation system that the liquid is alkaline or at least neutral.

* * * * *